United States Patent [19]

Lyons

[11] 4,261,522

[45] Apr. 14, 1981

[54] FEED AND VENT APPARATUS FOR REFINERS

[75] Inventor: William E. Lyons, Springfield, Ohio

[73] Assignee: The Bauer Bros. Co., Springfield, Ohio

[21] Appl. No.: 58,933

[22] Filed: Jul. 19, 1979

Related U.S. Application Data

[63] Continuation of Ser. No. 875,386, Feb. 6, 1978, abandoned.

[51] Int. Cl.[3] ..... B02C 7/11

[52] U.S. Cl. ..... 241/246; 241/248

[58] Field of Search ..... 241/244, 245, 246, 247, 241/251, 24 B, 261.2, 261.3

[56] References Cited

U.S. PATENT DOCUMENTS 4,059,237 11/1977 Mannstrom ..... 241/246

4,132,366 1/1979 Engall ..... 241/245

FOREIGN PATENT DOCUMENTS 2442627 1/1975 Fed. Rep. of Germany ..... 241/245

931929 7/1963 United Kingdom ..... 241/245

*Primary Examiner*—Mark Rosenbaum

*Attorney, Agent, or Firm*—Jerome P. Bloom

[57] ABSTRACT

The feed and vent apparatus as illustrated comprises a pair of tubes, one constituting an infeed and the other a primary vent tube, joined by an adapter to form an essentially V-shaped structure at the apex of which is an opening from one end of each tube. Material feed means which bridge and substantially fill the cross section of the infeed tube receive the material to be refined from an integrated hopper by way of an opening in the tube which extends a substantial portion of its length. A similar opening in the upper side of the primary vent tube leads to an extension of the escape passage defined thereby the cross section of which is sharply and abruptly expanded. The lowermost portion of the primary vent tube embodies, in a limited portion of its cross section means for receiving and carrying solids attempting to pass through the primary and secondary portions of the escape passage defined by the vent tube and its extension back to the refiner to which the V-shaped structure is connected.

15 Claims, 9 Drawing Figures

2
2
6
6
7
7
40
41
42
43
44
45
46
47
48
49
50
53
54
55
56
64
69

FEED AND VENT APPARATUS FOR REFINERS

This application is a continuation of my co-pending application for U.S. Letters Patent Ser. No. 875,386 filed Feb. 6, 1978 for FEED AND VENT APPARATUS FOR REFINERS, now abandoned.

BACKGROUND OF THE INVENTION

This invention relates to new and improved means and methods for feeding pulp refiners, particularly double disc refiners.

An inherent and ever continuing problem in the operation of refiners, particularly disc refiners, has been the steam created within the refiner during the refining procedure. The material being refined either embodies or is entrained in a significant amount of liquid. This is a source of a great amount of steam as the electrical energy applied to the refining process is converted to heat. The steam so developed creates a blow back condition which usually interferes with the infeed of the material to be refined, to the extent that the feeding is sometimes blocked. In any event this blow back condition produces variations in the load on the motors which drive the refining elements and this adversely affects stock quality. The creation and holding of the steam within the refiner in excess amounts can itself have the same effect. The problem is so serious that there have been many, many solutions offered in this respect, some feasible for certain applications but none of which really solve the basic problem. Such solutions as have been proposed which are pertinent to an understanding of the present invention are evidenced in the following patents and publication:

U.S. Pat. Nos. 4,059,237; 3,845,910; 3,441,227; 1,795,603; 2,561,043

French Pat. No. 2,183,928

British Pat. No. 931,929

German (Offenlegungsschrift) 24 42 627

The solution of none of the noted patents provide benefits equal to those unexpected results which stem from use of the features of the present invention.

The prior art practice has not only affected quality of the refined product when the noted problem has been encountered but has resulted also in a reduction in the quantity of the refined product per unit time. As will be obvious, this has serious economical overtones and such overtones have increased the demand for solution of the problem.

There has been one more pertinent patent that has issued from an application previously co-pending with the present application. This U.S. Pat. is that of Engall, No. 4,132,366 dated Jan. 2, 1979. It reveals an approach to the problems above enumerated pertinent to that forming the subject matter of this case but the tack thereof is different and does not envision or embody distinctive features of the present invention as hereinafter disclosed and set forth in the appended claims.

SUMMARY OF THE INVENTION

This invention provides improvements in feed and vent apparatus affording a solution to the above mentioned problem in a highly satisfactory manner. It has particular advantage in application to disc refiners and will be so described by way of illustration.

A preferred embodiment comprises a pair of tubes, one constituting an infeed and the other a primary vent tube, joined by an adapter to form an essentially V-shaped structure at the apex of which is an opening from one end of each tube. Material feed means which bridge and substantially fill the cross section of the infeed tube at its delivery end receives the material to be refined by way of an opening in the upper side of the infeed tube which extends a substantial portion of its length. An opening in the upper side of the primary vent tube leads to an extension the cross section of which is relatively expanded. The lowermost portion of the primary vent tube embodies means for receiving and carrying solids attempting to pass through the primary and secondary portions of the passage defined by the vent tube and its extension back to the infeed opening of the refiner to which the apex of the invention apparatus is applied.

The construction is such to preclude any significant interference with infeed of material to the refiner by back-blown steam. It provides that the back-blown steam will follow the path of least resistance. In the process of its escape the steam is stripped of entrained solids by reason of the configuration and arrangement of its escape passage which is initially uniform to establish a required initial velocity of its flow and then sharply expanded to produce the stripping action.

A further feature of the invention apparatus provides a feed hopper integrated with the infeed tube in a manner to insure a maximum and most efficient flow of the material to be refined to the infeed tube and further to insure that this material essentially fills the cross section of the infeed tube at its discharge end.

An embodiment of the invention thus provides a structure including an infeed tube and a primary vent tube joined at one end to have openings from each thereof adapted to be commonly communicated with the infeed opening of a refiner. The structure preferably has a generally V-shaped configuration and a generally vertical orientation, the legs being provided by the infeed tube and the primary vent tube and the apex portion which joins the tubes being adapted to serve as a coupling for connection thereof to a refiner, about its infeed opening.

In a preferred embodiment the escape passage defined by the primary vent tube is extended by a secondary tube, the cross section of which is greater than that of the primary vent tube, connected to an opening at its upper side. The expanded cross section of the secondary tube causes a reduction in the velocity of flow of the escaping steam sufficient to permit entrained solids to drop therefrom under the influence of gravity, back into the primary vent tube, across the lower interior surface of which the solids are then moved for eventual reentry to the infeed opening of the refiner to which the invention apparatus is coupled.

The operation of the feed and vent apparatus is simple and highly effective in use. The flow of materials and the escape of steam is delineated and the steam vented is essentially free of solids at an objectionable level or of a substance such as might otherwise prevent a use of the steam. As a consequence load variation on the drive motors of the refiner apparatus is reduced to produce a higher grade as well as quantity of production per unit time.

It is therefore a primary object of the invention to provide infeed apparatus for a refiner which is simple in construction, more efficient and satisfactory in use and unlikely to cause malfunction.

A further object is to provide infeed apparatus for a refiner embodying a V-shaped tubular structure comprising a feed tube and a vent tube arranged to maintain a distinct separation of the material being fed to a refiner from such steam as may be developed in and blown back by the refiner and to further provide for a dispersement of this steam in a flow which is staged as to its velocity so the steam exits in a relatively clean and usable condition.

Another object is to provide an infeed apparatus embodying in connection therewith a positive steam venting arrangement which includes means to return directly to the refiner to which it is applied any material solids which may be entrained in the escaping steam which is vented thereby.

An additional object is to provide apparatus possessing the advantageous structural features, the inherent meritorious characteristics and the means and mode of operation herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein is shown one but not necessarily the only form of the embodiment of the invention, FIG. 1 is a generally diagrammatic outer end elevation view of the feed and vent apparatus of the invention as mounted for and in connection with the infeed opening of a disc refiner;

Figure 1:
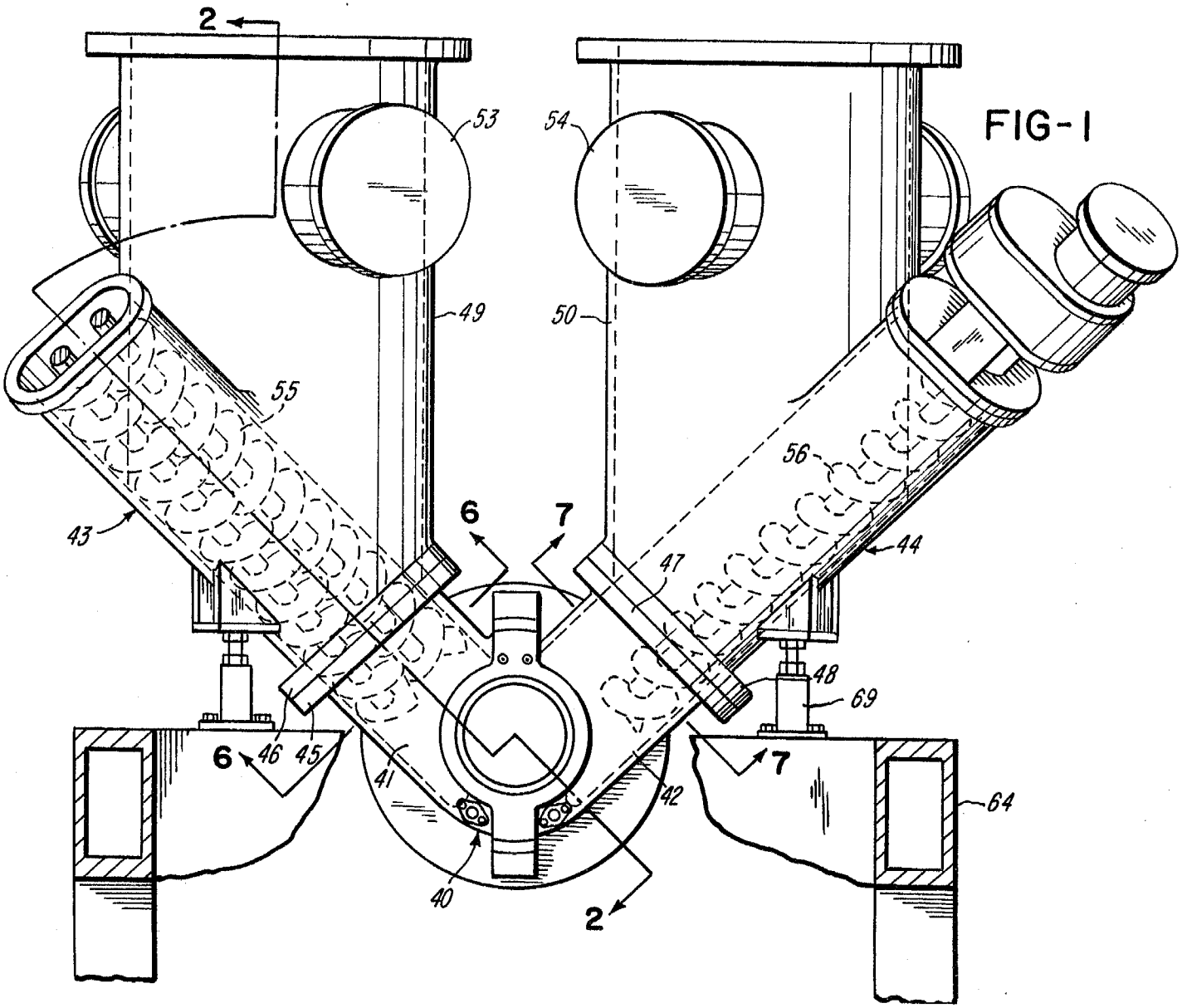
Figure 2:
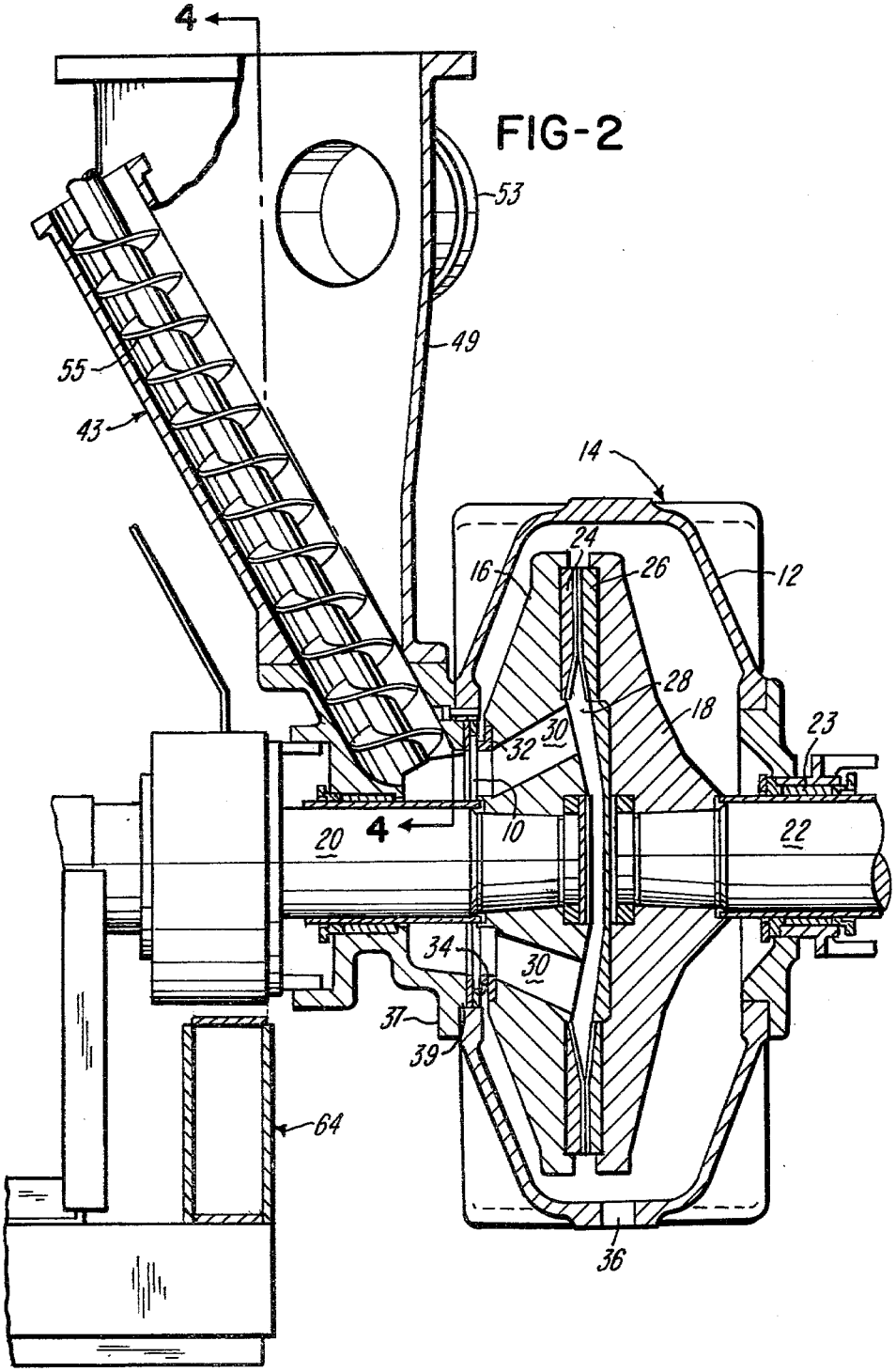
FIG. 2 is a cross sectional view of the apparatus of FIG. 1 shown in connection with a disc refiner, the latter of which is also shown in section and in a generally diagrammatic fashion.
Figure 6:
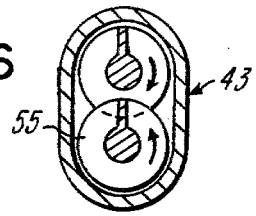
FIG. 6 is a cross sectional view of the infeed tube and the material feed means which is embodied therein, the view being taken on line 6—6 of FIG. 1.
Figure 7:
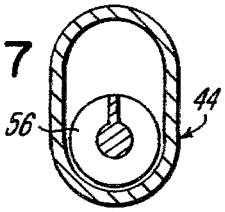
Figure 3:
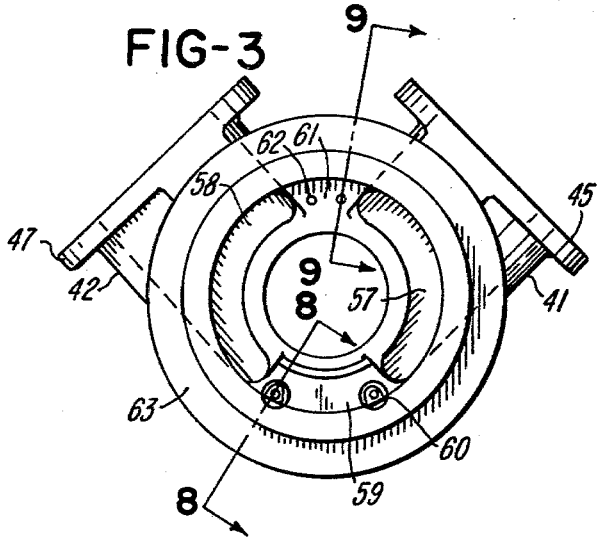
FIG. 3 is a view of the discharge side of the apex end of the generally V-shaped structure demonstrated in FIG. 1.
Figure 9:
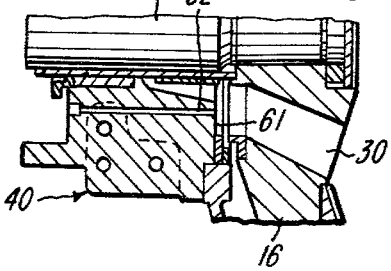
Figure 8:
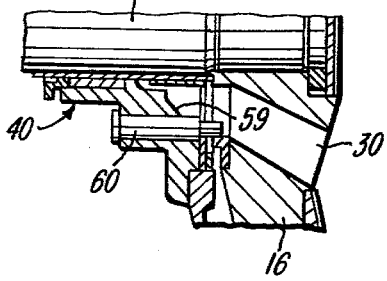
Figure 4:
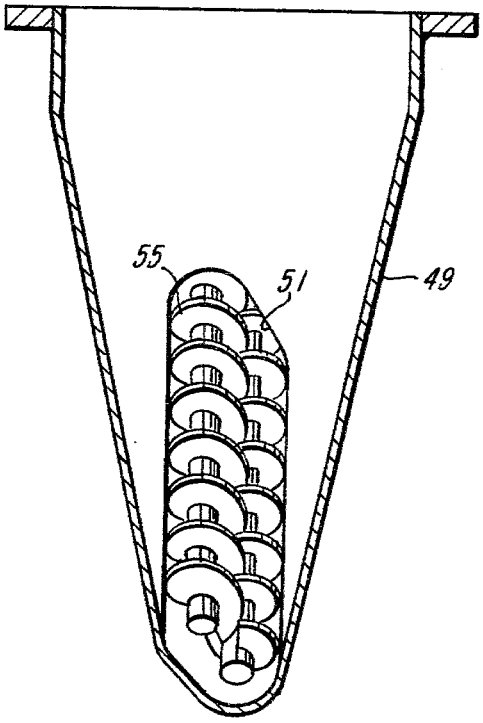
FIG. 4 is a view taken on line 4—4 of FIG. 2 to illustrate the inlet opening to the infeed tube portion of the apparatus of FIG. 1.
Figure 5:
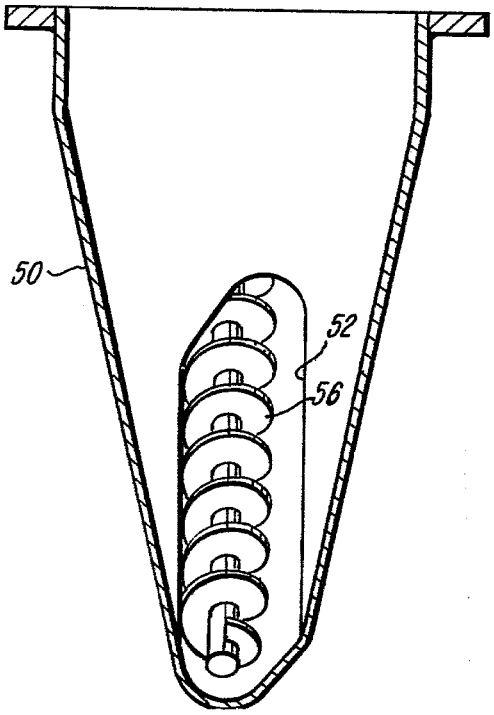
FIG. 5 is a similar view with reference to the outlet opening from the primary vent tube embodied in the apparatus of FIG. 1.

FIG. 7 is a cross sectional view of the vent passage in the structure of FIG. 1, taken on line 7—7 thereof; and FIGS. 8 and 9 are fragmentary sectional views respectively taken on lines 8—8 and 9—9 of FIG. 3, the apparatus being shown in connection with a disc refiner such as illustrated in FIG. 2.

Like parts are indicated by similar characters of reference throughout the several views.

As illustrated, the invention apparatus is coupled to an inlet opening 10 centered in one side of the housing 12 of a disc refiner 14. A pair of facing refiner discs 16 and 18 mount interiorly of the housing on the respectively adjacent ends of shafts 20 and 22. The shafts 20 and 22 respectively project outwardly of the housing, the shaft 20 through the approximate center of the inlet opening 10 and the shaft 22 through a housing seal 23 rimming an opening in the wall portion of the housing which is directly opposite the inlet 10. The adjacent faces of the discs 16 and 18 each mount a series of refiner plates 24, 26 which define an annular refining surface on the outer peripheral portion thereof. The annular refining surfaces 24, 26 are positioned in a closely spaced, generally parallel relation and in rimming relation to a space between the central portions of the opposed surfaces of the discs constituting the eye 28 of the refiner.

The disc 16 is an infeed disc which includes a plurality of feed passages 30. The entrance ends of the feed passages 30 position adjacent the inlet 10, in a circularly spaced relation, concentric to and immediately about the shaft 20. The passages 30 uniformly diverge from their entrance ends to their discharge ends, the latter of which open to the eye of the refiner immediately inward of the annular refining surface 24.

The entrance ends of the passages 30 are rimmed at their outer periphery by a ring-like element 32 including a cylindrically formed projection which extends within and in a coaxial relation to the inlet 10 to position in a male-female relation within a complementarily shaped ring element 34 which lines the inlet 10. The elements 32 and 34 constitute on the one hand a rotating seal element and on the other a fixed seal element which on rotation of the infeed disc 16 form a seal to inhibit material which enters the inlet 10 from bypassing the feed passages 30.

The housing 12 is provided with an appropriate outlet represented diagrammatically in FIG. 2 by the opening 36.

It is to be understood that details of the disc refiner and its mount are only diagrammatically illustrated and they are described only to the extent necessary for the understanding of the application of the present invention.

The feed and vent apparatus illustrated includes a substantially V-shaped tubular structure comprising an infeed tube 43 and a primary vent tube 44 respectively connected to and forming axial extensions of the short divergent legs 41 and 42 of a generally V-shaped adapter 40. The adapter 40 defines the apex or lower end of the "V" and its apex has a configuration resembling that of a cup placed on its side. The mouth of the cup is rimmed by a lip 39 the outer peripheral surface of which is configured and sized (FIG. 2) to fit within and line the wall surface which rims the inlet opening 10 outward of and in backing relation to the seal ring 34. A peripheral flange 37 about and offset rearwardly of the lip is in the application of the cup releasably fixed to the outer surface of the housing 12 about the inlet 10. The leg portions 41 and 42 of the adapter 40 join to and diverge from the cup and open through respectively opposite sides thereof to the interior of the cup at its base, respectively by way of an arcuate aperture 57 and an arcuate aperture 58. The apertures 57 and 58 lie in an outer annular portion of the cup base and each has an arcuate extent of about 135°. Having consideration for the orientation of the adapter 40 as applied to the refiner housing 12, interposed between the lowermost ends of the openings 57 and 58 is an arcuately formed block-like structure 59 which projects inwardly of the cup from its base and has projected through passages therein a pair of nozzles 60. A similar diametrically opposite projection from the base of the cup-shaped portion of the adapter 40 provides a separator 61 between the uppermost ends of the openings 57 and 58. A pair of small bore nozzles 62 are projected through small bore passages in the projection 61. The projections 59 and 61 are in rimming relation to a central aperture in the base of the cup-like portion of adapter 40 which accommodates the projection therethrough of the shaft 20, in bearing relation thereto, a seal being provided therebetween. The arrangement of the arcuate projections 61 and 59 and the shaft 20 provide that the openings 57 and 58 are physically separated as the adapter mounts to the refiner. Also there is provided at the respective ends of each opening 57 and 58 a nozzle, at one end a nozzle 60 and at the other a nozzle 62, through the medium of which jets of fluid may be directed outwardly of the cup portion of the adapter to assist in the function of the feed and vent apparatus.

The infeed tube 43 and the leg portion 41 are interconnected by abutting external flanges 46 and 45 on their respectively adjacent ends. Bolts interconnect these flanges and a seal is provided therebetween. The primary vent tube 44 and the leg portion 42 are similarly interconnected through the medium of external flanges 48 and 47 on their respectively adjacent ends.

It is to be noted that the V-shaped structure of the invention is supported by jack-like devices 69 which are mounted on and in connection with upper surface portions of partitions of the refiner base 64. Details of the refiner base are not further described since in and of themselves they lend no feature exhibiting improvements of the present invention.

A pair of overlapped feed screws 55 are contained within and extend substantially the length of the infeed tube 43 and have their discharge ends extended into the leg 41 of the adapter 40 to a point adjacent the infeed outlet 57. The tube 43 and the connected leg portion 41 are configured so the wall thereof wraps around the twin screws 55 to immediately confine the same. This gives the infeed passage so designed a cross section which has an oblong configuration, including parallel sides adjacent ends of which are bridged by wall surface portions which are arcuate in configuration. It will be seen from the drawings that the screws are stacked one upon the other so their axes lie in a vertical inclined plane generally transverse to the central longitudinal axis of the cup-shaped apex portion of the adapter 40. The major dimension of the cross sectional configuration of the tube 43 and the leg portion 41 has the same orientation, one which in the assembly of the V-shaped structure and its application to the refiner will be in a plane inclined from a perpendicular to the shaft 20, away from the refiner, by about 30°.

The tube 43 is provided with an opening of substantial length in its uppermost arcuate wall portion, extending upwardly from the flange 46. Connected integral with the tube 43 and about the opening in its upper wall portion and to the flange 46 is the lower end of the wall structure of an upwardly directed tubular projection 49. In horizontal section this projection is circular in configuration and forms a hopper-like feed passage for directing material to be refined to and through the opening in the upper side of the infeed tube. In the case illustrated this opening is somewhat longer than about one-half the length of the tube. Thus, when material to be refined is delivered to and through the vertically oriented tubular projection 49, the material so passed will deposit on the upper of the screws 55 within the tube 43, substantially one-half the extent of its length. Upon energization of the screws 55 there will accordingly be a positive and rapid movement of the material to be refined downwardly of the tube 43 and the leg portion 41 and inwardly of the cup-shaped portion of the adapter 40 by way of the infeed opening 57. The movement of this material is smooth and positive and, as will be seen, it will be discharged outwardly of the adapter in an area thereof which is separated from the aperture 58 forming the entrance to the vent passage defined by the leg portion 42 and the primary vent tube 44. This positive feed of the material to be refined will be enhanced as to its delivery by jets of fluid directed through nozzles 60 and 62 and there will be free passage of the material to be refined to the interior of the refiner and the rotating discs and to and through the feed passages 30 provided in the disc 16.

The cross sectional configuration of the vent tube 44 and the leg portion 42 is in this case identical with that of the tube 43 and the leg portion 41 and it is similarly oriented. Further, the vent tube 44 has an opening of substantial length in its upper side portion which is identical to that provided in the tube 43 and this opening is rimmed also by an upwardly and vertically projected tubular construction 50 which is similar to the tubular projection 49 in connection with the feed tube 43. In this case, however, the leg portion 42, the primary vent tube 44 and the tubular projection 50 serve as successive portions of a continuing escape passage for the steam which they vent from the refiner housing 12 by way of its inlet 10. As will be seen, the entrance to this escape passage is provided by the opening 58 in the adapter 40, at its base. The leg portion 42 defines a portion of the escape passage adjacent its entrance end which is essentially uniform in cross section and continued by the similarly configured portion of the passage in the primary vent tube 44. However, the extension of the passage from the primary vent tube 44 is by way of a substantial opening in the top of the latter which defines a gateway to a continuing portion of the escape passage defined by the tubular structure 50 which is sharply increased in cross section. The dimensioning of this increase with respect to the preceding cross section of the escape passage will be such to drop the velocity of the flow of escaping steam below that level required to maintain entrainment in the escaping steam of solids attempting to escape with the steam.

Contained in and extending substantially the length of the primary vent tube 44 and the leg portion 42 of the adapter 40, adjacent the lower interior surface portions is a single feed screw 56 the diameter of which, noting FIG. 7, is approximately half the length of the major dimension of the cross section of the escape passage which extends therethrough. The upper and outermost end of the primary vent tube 44 has a cap with which is interconnected a unit for driving the screw 56 upon application thereto of a suitable source of power. The upper and outermost end of the infeed tube 43 has a similar cap (not shown) mounting a drive unit for the overlapped feed screws 55.

With reference to the escape passage provided by the leg portion 42, the primary vent tube 44 and the tubular structure 50, as mentioned previously, the design of the escape passage is one to first provide a uniform high velocity flow of the steam vented from the refiner housing 12 followed by a sudden expansion of the cross section of the escape passage which induces entrained solids which may be picked up in minimal amounts in the vent of steam to self strip from the flow of the steam as the velocity of its flow is suddenly reduced. The solids so stripped will inherently drop back into the vent tube 44 to its lower side where they will be picked up by the screw 56 which will turn to drive the solids in a positive fashion back to and through the opening 58 for movement back into and between the discs by way of the feed passages 30 which open to the eye of the refiner.

Each of the tubular projections 49 and 50 which respectively serve as a feed hopper and a portion of the vent system have observation and access ports 53 and 54.

One particular point in reference to the construction of the feed and vent structure is that as the adapter 40 is applied to the refiner the orientation is such that the center line of the upper of the screws 55 passes through the center line of the refiner. This arrangement is such to allow more efficient use of the lower parts of the feed disc passages 30 when disposed at their lowermost position where gravity tends to cause the material being fed to collect. The jets delivered by way of the nozzles 60 and 62 are appropriately dimensioned with the latter point in mind, the larger of the jets being lowermost since in the feed of the stock into the refiner there will be less stock in the upper portion of the inlet opening 10 than in the lower portion.

Thus, in use of the invention apparatus, the drive motors for the shafts 20 and 22 will be suitably energized and simultaneously the screws 55 and 56 will be energized. As this occurs and stock is fed through the hopper 49 it will drop through the opening in the top of the infeed tube 43 which extends a substantial portion of its length and on to a corresponding length of the upper of the overlapped feed screws 55. As the feed screws 55 operate they will mutually function to direct the material to be refined in a sense the length thereof and inwardly of the leg portion 41 to the opening 57 in the base of the cup-shaped portion of the adapter 40 which faces the left hand side of the inlet opening 10 to the refiner housing 12. At the same time, fluid will be directed in jet form inwardly of the inlet opening to the side of the opening 57 most adjacent the central vertical plane of the inlet 10. This will insure a directed flow of the material being fed to and through the channel defined about the shaft 20 by the seal elements 34 and 32 and to the entrance ends of the rotating feed passages 30 which they rim. This feed will be directed to the eye 28 of the refiner and the natural direction thereof together with the influence of the opposed faces of the rotating discs 16 and 18 will induce this material to move outwardly between the refining plates 24 and 26 in the process of which to be reduced thereby and discharged as refined material interiorly of the housing 12, which material is directed from this housing by way of its outlet 36. At the same time, the steam developed in the course of application of energy to the rotating discs, by reason of the fact that a substantial amount of water is embodied in the material delivered, or the material will be delivered in an entrained relation to liquid, will backflow to the inlet 10 where it will follow the path of least resistance and exit or vent through the opening 58 facing one side of the inlet which is separated from the opening 57 through which material is being delivered. With the arrangement as described, the twin screws 55 which bridge the infeed passage and the material which they are swiftly and effectively delivering in effect blocks any tendency that steam might have to move in this direction and the steam will inherently seek the unblocked entrance to the escape passage defined by the leg portion 42, the primary vent tube 44 and the tubular projection 50. As mentioned previously, the leg portion 42 in connection with the entrance opening 58 will establish the initial flow velocity of the escaping steam by reason of a substantially uniform cross section which is continued by the primary vent tube 42. From the primary vent tube 42, in bypassing relation to the feed screw 56, the escaping steam filling the vent tube will move outwardly therefrom by way of the substantial opening in its upper side into the abruptly and substantially expanded cross section of the continuing portion of the escape passage defined by the tubular projection 50. In this latter portion the expansion of the passage slows the velocity of the steam flow to a level such that it will not support the entrained solids. The solid particles therein which have been picked up by the escaping steam in movement from the refiner, which will be minimal in substance, will then drop to the bottom lower interior side of the primary vent tube, by way of the opening therefrom, where they will be picked up and positively delivered back to the connected refiner by way of the opening 58. The movement of these returned particles will be assisted by the jets from the nozzle 62 and 60 at the respective ends of the opening 58. The solids so returned will move into and intermingle with the flow of the material which is being delivered by way of the infeed tube 43.

The operation of the feed and vent apparatus of the invention has proven to be extremely efficient. It has been indicated in test that there appears to be in use of the apparatus an improved separation of the steam passing from the refiner and the material delivered thereto. As noted previously, flow of steam reversely through the leg 41 and infeed tube 43 is blocked not only by the overlapped screws 55 but by the continuously filling of the screws by the material being delivered. Any steam which is back blown through the passages 30 in the free areas thereof will be essentially directed to the interior side of the cup portion of the adapter which includes the aperture 58. The flow of the venting steam and the stripping and extraction of entrained solids is as previously described.

It must be recognized that this is not a case where the venting arrangement is embodied as a physical part of the infeed tube. Rather the venting structure is distinctly separated. Moreover, the symmetric disposition of the V-shaped structure of the invention and the orientation of the screws embodied therein insures a most effective and smooth functioning of the apparatus. This is distinct from the prior art construction where, for example, in the main, the concepts in this direction have been carried out by means requiring that steam which must be vented must pass through feed screws and/or material being fed. In contrast to any developments in this area of which the present inventor is aware, for one reason or another including those herein set forth, there is distinct improvement in the infeed of material to a refiner in accordance with the application of the invention as herein described.

The feature of the positive return of materials of any significant nature which might attempt to escape with venting steam is a point of novelty which is quite important where the steam may be desired for use in a condition essentially free of solids of perceptible size.

Not only do the feed means in the form of feed screws as herein illustrated positively direct material to and through the feed disc openings but, as will be seen from the particular embodiment illustrated, the feed and vent tubes as well as the contained screws may be readily interchanged in installations where the same might be required. The importance of this from the standpoint of cost is or should be quite obvious to those versed in the art.

In any event, tests have shown that the structure of the present invention has resulted in a refining operation wherein there is more uniform feed than heretofore encountered and, more importantly, the normal instance of interference of vented steam with infeeding material has been substantially eliminated. Operation of the invention apparatus as shown has resulted in more uniform motor load in respect to the refiner to which it has been applied. An unexpected advantage of the invention is that the use of the invention apparatus gives an opportunity to put a greater amount of material through a single refiner in a given period of time.

The apparatus thus results in a higher production of a more uniform quality end product in a single pass of the material to be refined through a single refiner.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for connection to the infeed opening of a refiner, particularly a disc refiner, comprising an infeed tube structure and a steam vent tube structure, said infeed tube structure providing means defining therein a flow passage including an infeed end and a delivery end, said steam vent tube structure providing means defining therein a flow passage including an entrance end and a discharge end, adapter means for connection to the infeed opening of a refiner, in capping relation thereto, said tube structures connecting to said adapter means to extend oppositely and outwardly therefrom in a divergent relation, said adapter means being constructed and arranged to provide direct and open communication of the delivery end of the flow passage in said infeed tube structure and the entrance end of the flow passage in said steam vent tube structure with the infeed opening of the refiner to which it is applied, the passage in said steam vent tube structure being a free flow passage for directing therethrough steam which exits from the related refiner by way of its infeed opening, said steam vent tube structure including distinct sections one of which is lowermost and another a next following section which extends upwardly therefrom, the cross sectional area of said uppermost section being abruptly and sharply enlarged from that defined in said lowermost section of said steam vent tube structure to produce a substantial reduction in velocity of the flow from said lowermost section which is effective to cause an inherent release of solids in the flow from said lowermost section and the return of such solids to said lowermost section, said lowermost section containing therein means to receive the released solids and to direct them back to the entrance end of said flow passage defined by said steam vent tube structure to be picked up and delivered for refining with material being delivered for this purpose by said infeed tube structure.

2. Apparatus as in claim 1 wherein said infeed tube structure contains overlapped feed screws which in application of said apparatus to the infeed opening of a refiner dispose one above the other, said overlapped screws being arranged to substantially fill the cross sectional area of the flow passage defined in said infeed tube structure, said infeed tube structure having the infeed end of said passage defined therein providing an opening for delivery of material thereto in an area thereof limited to the location of and simultaneously along an extended portion of the length of the uppermost of said feed screws in an arrangement to facilitate a low power consumption and rapid and efficient delivery of the material to the related refiner, the arrangement of said overlapped feed screws and the delivery thereby of the material to be refined providing a block to a reverse flow of steam through said infeed tube structure, to dictate that the flow of such steam as exits from the related refiner will inherently seek and pass through the flow passage defined by said steam vent tube structure.

3. Infeed apparatus as in claim 2 wherein said delivery opening is in a portion of said infeed tube structure disposing uppermost in use, and communicates directly with a portion of the length of the uppermost of said overlapped feed screws which approaches at least one-half the length of the tube section of said infeed tube structure occupied by said feed screws.

4. Apparatus as set forth in claim 1 wherein said distinct sections of said steam vent tube structure are angularly related and at the same time connected to provide that said following section projects from one side of said one section and said one section extends transversely of said following section.

5. Apparatus as in claim 4 wherein said apparatus is constructed and arranged to provide that in the mounting thereof to the infeed opening of a refiner said following of said angularly related sections of said steam vent tube structure opens to said one section thereof opposite a downwardly inclined interior surface portion thereof, along which said means to receive and direct the released solids is positioned.

6. Apparatus as in claim 5 wherein said means to receive and direct said released solids is a screw type feeder device positioned in said one of said angularly related sections of said steam vent tube structure in an area thereof limited to the lowermost interior surface portion thereof, having regard for the disposition of said steam vent tube structure in use.

7. Apparatus as in claim 1 wherein said infeed tube structure is substantially bridged as to its cross sectional area by overlapped feed screws, at least at the delivery end of said passage therein, and said steam vent tube structure includes in said one of said angularly related sections thereof a single feed screw positioned in an area limited to one side of a portion thereof adjacent the entrance end of said passage therein in an arrangement to leave and assure a free flow passage thereby for steam exiting from the infeed opening of the related refiner, said feed screw in said vent tube structure serving to provide said means to receive said released solids.

8. Apparatus as in claim 1 wherein said tube structures each include a plurality of tube sections joined together to effect an integrally connected relation thereof and said steam vent and said infeed tube structures are formed to have an essentially identical configuration to enable their interchangeability as to their application.

9. Apparatus as in claim 1 wherein said tube structures are separate tube structures which connect to said adapter at respectively opposite sides thereof and are otherwise separated, form with said adapter a substantially V-shape, and mount, in application of said adapter to the infeed opening of the refiner, in positions wherein they are inclined both from a vertical and to a horizontal plane.

10. Apparatus as in claim 1 wherein at the delivery end of its flow passage said infeed tube structure has a non-circular cross sectional configuration which wraps around and conforms generally to the configuration of the cross section of a pair of overlapped feed screws which dispose one above the other therein.

11. Apparatus as set forth in claim 10 wherein the flow passages of said tube structures are communicated with the interior of the capping adapter through arcuate openings in its wall structure to commonly expose the delivery end of said flow passage in the infeed tube structure and the entrance end of said flow passage in said steam vent tube structure to the infeed opening of the related refiner, said adapter including means separating said arcuate openings embodying jet devices serving for the delivery therethrough of fluid to insure a directed and positive movement of material delivered to said adapter to the interior of the related refiner by way of its infeed opening.

12. Apparatus as in claim 10 wherein the arrangement of the feed screws in said infeed tube structure provides that on the application of said feed screws to the infeed opening of a related refiner the upper of these screws has its center line pass through the center line of the related refiner.

13. Apparatus for application to the infeed opening of a refiner, particularly a disc refiner comprising an infeed tube structure providing means defining therein a flow passage including an infeed end and a delivery end an adapter arranged for application to and connection with an infeed opening of a refiner, said flow passage having its delivery end opening to said adapter, which is constructed and arranged to provide communication thereof with the infeed opening of the refiner to which said adapter is applied, said infeed tube structure having therein a pair of overlapped feed screws one of which positions above the other in use, said infeed end of said passage being provided by an opening in said infeed tube structure for delivery to said feed screws of the material to be refined, said opening to said infeed tube structure being constructed and arranged to direct the material to be refined to an area of said feed screws limited to said one of said feed screws and simultaneously along a substantial portion of its length approaching one-half thereof or more, to be carried by said one of said feed screws to the other of said feed screws whereby to smoothly, swiftly and efffectively deliver the material to be refined to the infeed opening of the related refiner, said overlapped feed screws being so peripherally confined that in the delivery of the material to be refined from said infeed tube structure there is an essential block against entrance thereto of steam from the refiner to which said adapter is applied.

14. Apparatus as in claim 13 wherein said adapter is constructed and arranged to cap the infeed opening of the refiner to which it is applied and has an opening therefrom substantially separated from the delivery end of said flow passage in said infeed tube structure for free passage therethrough of steam escaping from the infeed opening of the related refiner.

15. Apparatus for application to the infeed opening of a refiner, particularly a disc refiner, having means for delivery thereto of material to be refined, including a steam vent tube structure providing means defining therein a flow passage including an entrance end and a discharge end, said steam vent tube structure comprising tube portions one of which includes said entrance end of said flow passage said one of said tube portions having in connection therewith means to place said entrance end of said flow passage in communication with the infeed opening of the related refiner, said one tube portion being followed by a second tube portion which is angularly related thereto, said tube portions being constructed and arranged so that in application of said apparatus to the infeed opening of a refiner and in use thereof said one thereof positions lowermost and said second forms an upwardly directed extension of said lowermost tube portion, the cross sectional area of said passage in said uppermost tube portion being substantially and abruptly enlarged from that in the portion of said passage in the lowermost tube portion, a screw device housed in a limited portion of the cross sectional area of the passage in said lowermost tube portion in a construction and arrangement providing for free flow thereby of steam escaping from the infeed opening of the related refiner through said lowermost tube portion and to said uppermost tube portion, the enlargement of the cross sectional area of the portion of the passage in said upper tube portion being such as to produce a sharp reduction in the velocity of the steam which is directed thereto from said lowermost tube portion the level of which induces an inherent release from the steam of entrained solids for movement thereof in a direction reverse to that of the flow of the steam exiting from the infeed opening of the related refiner, said screw device being operative to pick up and positively direct said released solids back to the area of the infeed opening of the related refiner.

* * * * *